US012529379B1

(12) United States Patent
Shen

(10) Patent No.: US 12,529,379 B1
(45) Date of Patent: Jan. 20, 2026

(54) MINIATURE PUMP

(71) Applicant: ASIA VITAL COMPONENTS CO., LTD., New Taipei (TW)

(72) Inventor: Ching-Hang Shen, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 18/931,222

(22) Filed: Oct. 30, 2024

(30) Foreign Application Priority Data

Sep. 30, 2024 (TW) ..... 113137419

(51) Int. Cl.

| | |
|---|---|
| ***F04D 1/00*** | (2006.01) |
| ***F04D 1/06*** | (2006.01) |
| ***F04D 13/02*** | (2006.01) |
| ***F04D 13/06*** | (2006.01) |
| ***F04D 25/06*** | (2006.01) |
| ***F04D 29/046*** | (2006.01) |
| ***F04D 29/40*** | (2006.01) |
| ***F04D 29/42*** | (2006.01) |

(52) U.S. Cl.
CPC ..... *F04D 1/00* (2013.01); *F04D 13/06* (2013.01); *F04D 29/046* (2013.01); *F04D 29/426* (2013.01); *F04D 1/063* (2013.01); *F04D 1/066* (2013.01); *F04D 13/025* (2013.01); *F04D 25/0606* (2013.01); *F04D 29/40* (2013.01)

(58) Field of Classification Search
CPC combination set(s) only.
See application file for complete search history.

(56) References Cited

U.S. PATENT DOCUMENTS 5,575,630 A * 11/1996 Nakazawa ..... A61M 60/422 417/420
7,371,056 B2 * 5/2008 Ito ..... F04D 13/0673 361/698
9,512,852 B2 * 12/2016 Wampler ..... A61M 60/419
2007/0231135 A1 * 10/2007 Wampler ..... F04D 29/2266 415/229

(Continued)

FOREIGN PATENT DOCUMENTS

CN 210423140 U 4/2020
CN 113586459 A 11/2021

(Continued)

OTHER PUBLICATIONS

Search Report dated Jul. 28, 2025, issued by Taiwan Intellectual Property Office for counterpart invention application No. 113137419.

*Primary Examiner* — Binh Q Tran
(74) *Attorney, Agent, or Firm* — Demian K. Jackson; Jackson IPG PLLC

(57) ABSTRACT

A miniature pump including a pump housing, a rotor, a stator, a closing member connected to the top side, and a holding member. The pump housing includes a top side forming a pump chamber, a bottom side, an inlet and an outlet. An end of a shaft is fixed in the pump chamber, and a bearing is pivoted on the shaft. The rotor is provided in the pump chamber to circulate a working fluid passing through the pump chamber. The holding member is disposed on a side of the closing member corresponding to the bearing, and another end of the shaft is accommodated in the holding member.

10 Claims, 7 Drawing Sheets

(56) References Cited

U.S. PATENT DOCUMENTS

| | | | | |
|---|---|---|---|---|
| 2007/0247009 | A1* | 10/2007 | Hoffman | F04D 25/0606 310/43 |
| 2008/0260515 | A1* | 10/2008 | Anami | F04D 13/0633 415/55.2 |
| 2009/0162225 | A1* | 6/2009 | Lai | F04D 13/064 310/87 |
| 2009/0169399 | A1* | 7/2009 | Wu | F04B 19/006 417/420 |
| 2014/0296615 | A1* | 10/2014 | Franano | A61M 60/37 600/16 |

FOREIGN PATENT DOCUMENTS

| | | | |
|---|---|---|---|
| TW | M585836 | U | 11/2019 |
| TW | M585837 | U | 11/2019 |
| TW | M665820 | U | 1/2025 |

* cited by examiner

MINIATURE PUMP

This application claims the priority benefit of Taiwan patent application number 113137419 filed on Sep. 30, 2024, the disclosure of which is hereby incorporated by reference in its entirety.

FIELD OF THE INVENTION

The present invention relates to a miniature pump, and more particularly, to a miniature pump capable of achieving the effect of avoiding friction.

BACKGROUND OF THE INVENTION

As electronic devices become more powerful, the components inside them generate more heat during operation. Installing heat sinks or cooling fins on these components is a common way to increase the surface area available for heat dissipation, thereby enhancing the heat dissipation performance. However, given that heat sinks and cooling fins achieve only limited heat dissipation, it is common to use miniature pump as a solution to enhance the heat dissipation performance.

The water-cooling apparatus is known to facilitate the exchange of thermal energy generated by the heat generation component (processor or graphics processor) with a cooling liquid within the water-cooling unit. Subsequently, the cooling liquid is circulated through a pump located within the water-cooling unit. The water-cooling unit is then connected to a heat sink through multiple tubes, allowing the cooling liquid to be circulated between the heat sink and the water-cooling unit via heat exchange, thereby dissipating heat rapidly from the heating element.

The internal pump structure of a conventional water-cooling device comprises a rotor with an impeller positioned within a chamber of the pump housing and a stator located externally to the pump housing. During operation, the shaft of the rotor will continuously rub against the pump housing during rotation while the impeller will also rub against the pump housing (or a partition plate inside the pump housing) due to its upward and downward axial movement, resulting in mechanical loss. This results in a reduction in the service life of the pump and the generation of noise when the shaft and impeller come into contact with the pump housing. Consequently, the inventor of this application and the manufacturers engaged in this industry are keen to investigate and enhance solutions to address these issues and shortcomings.

SUMMARY OF THE INVENTION

An object of the present invention is to provide a miniature pump that can avoid friction.

Another object of the present invention is to provide a miniature pump that effectively prevents impeller wear and prolongs service life by contacting the shaft with a holding member.

In order to achieve the above objects, the present invention provides a miniature pump, which includes a pump housing, a rotor, a stator, a closing member and a holding member. The pump housing includes a top side, a bottom side, an inlet and an outlet. A pump chamber is defined on the top side and the pump chamber communicates with the inlet and the outlet. One end of a shaft is fixed in the pump chamber, and a bearing is pivoted on the shaft. The rotor is provided in the pump chamber and exposed to a working fluid. The rotor is provided with an impeller and a magnetic member corresponding to the impeller. The impeller is located outside the bearing to circulate the working liquid passing through the pump chamber. The stator is disposed on the bottom side and corresponds to the magnetic member. The stator is isolated from the working fluid. A side of the closing member is connected to the top side of the pump housing to close the pump chamber. The holding member is provided on a side of the closing member corresponding to the bearing, and the other end of the shaft is accommodated in the holding member. The design of the miniature pump of the present invention effectively achieves the objective of avoiding friction and extending the service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The above objects of the present invention and its structural and functional features will be illustrated in accordance with the preferred embodiments of the accompanying drawings.

Figure 1A:
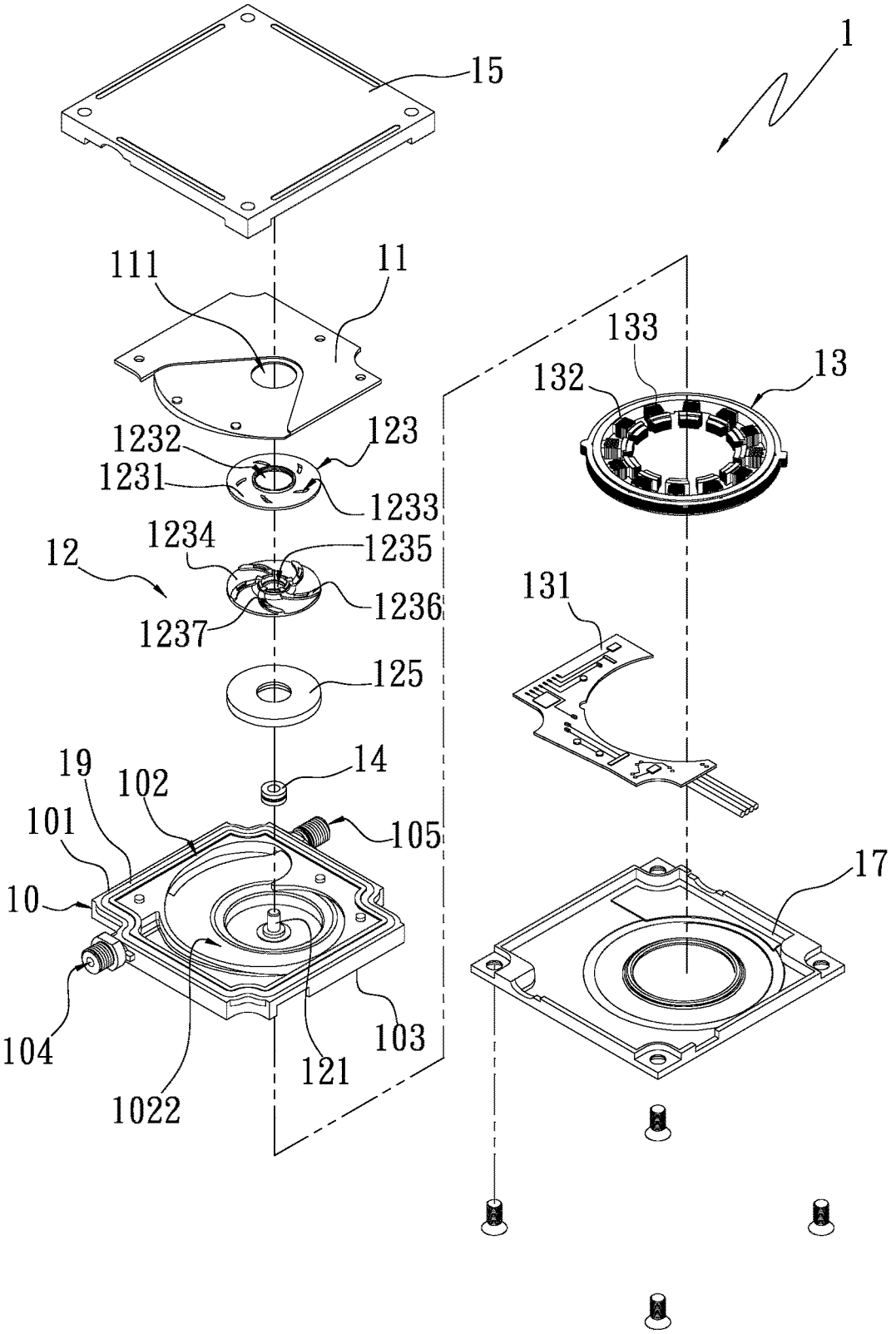
FIG. 1A is a three-dimensional exploded view of an embodiment of the present invention.
Figure 1B:
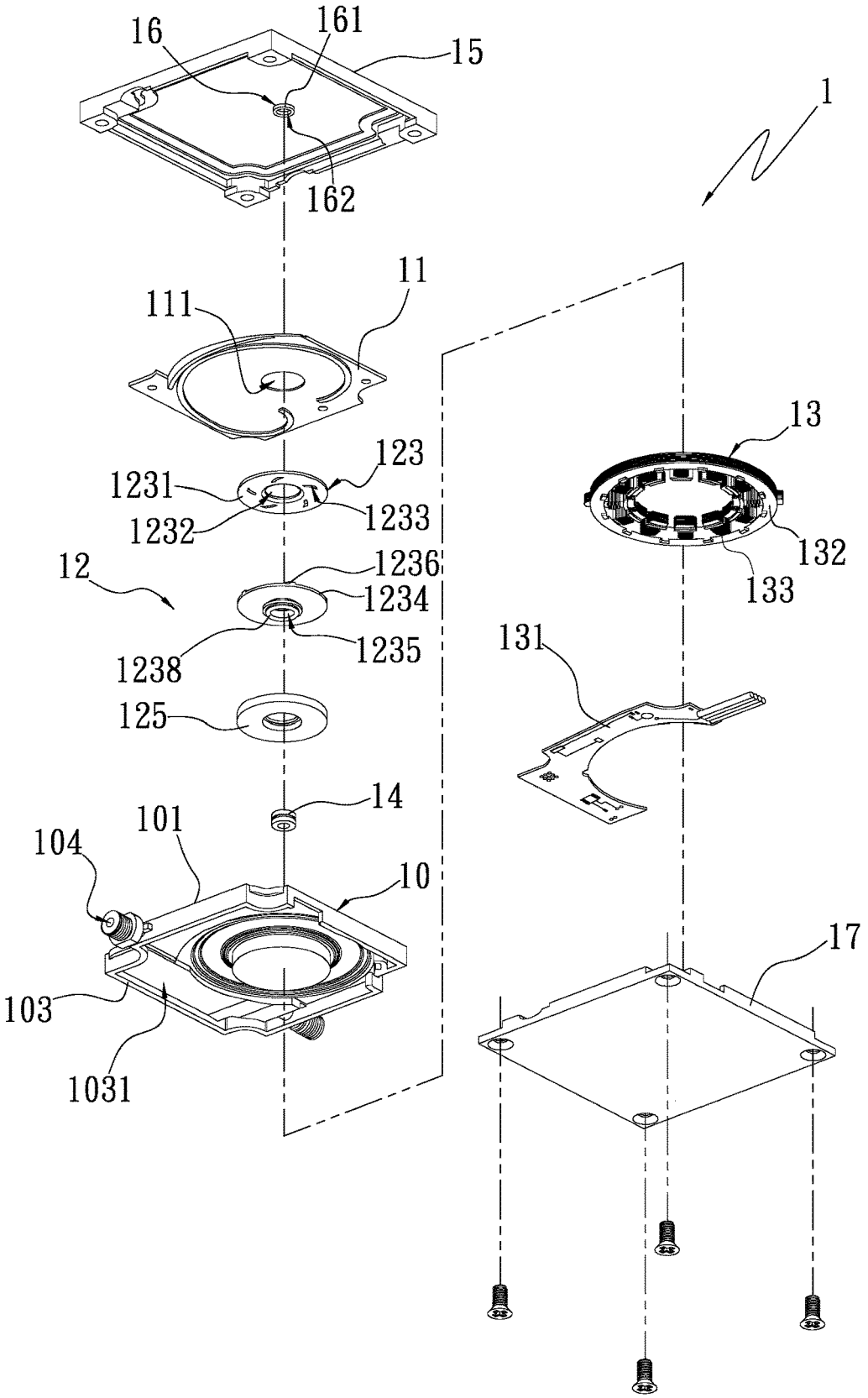
FIG. 1B is a three-dimensional exploded schematic diagram from another perspective of an embodiment of the present invention.
Figure 2A:
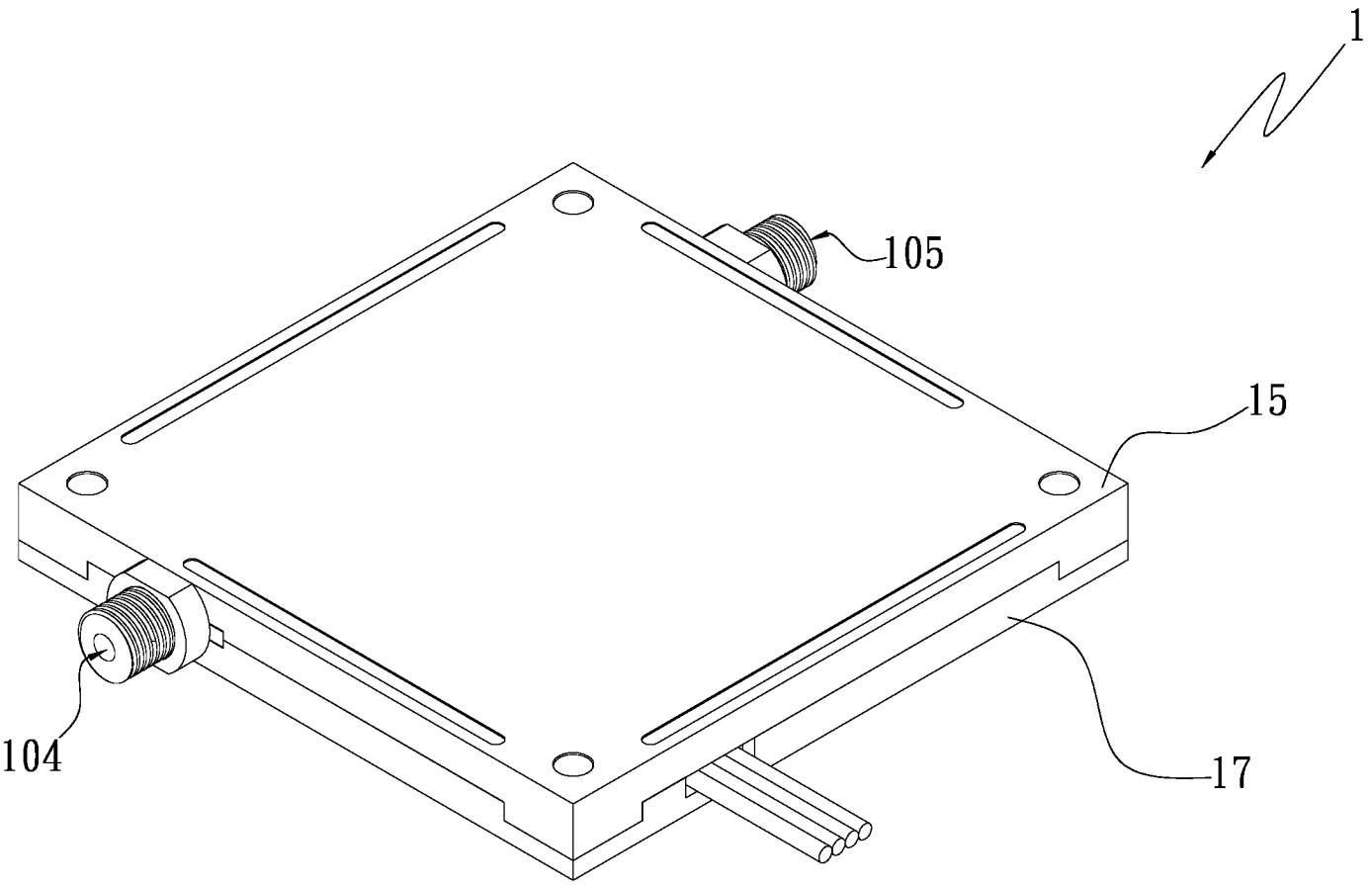
FIG. 2A is a schematic three-dimensional assembly diagram of an embodiment of the present invention.
Figure 2B:
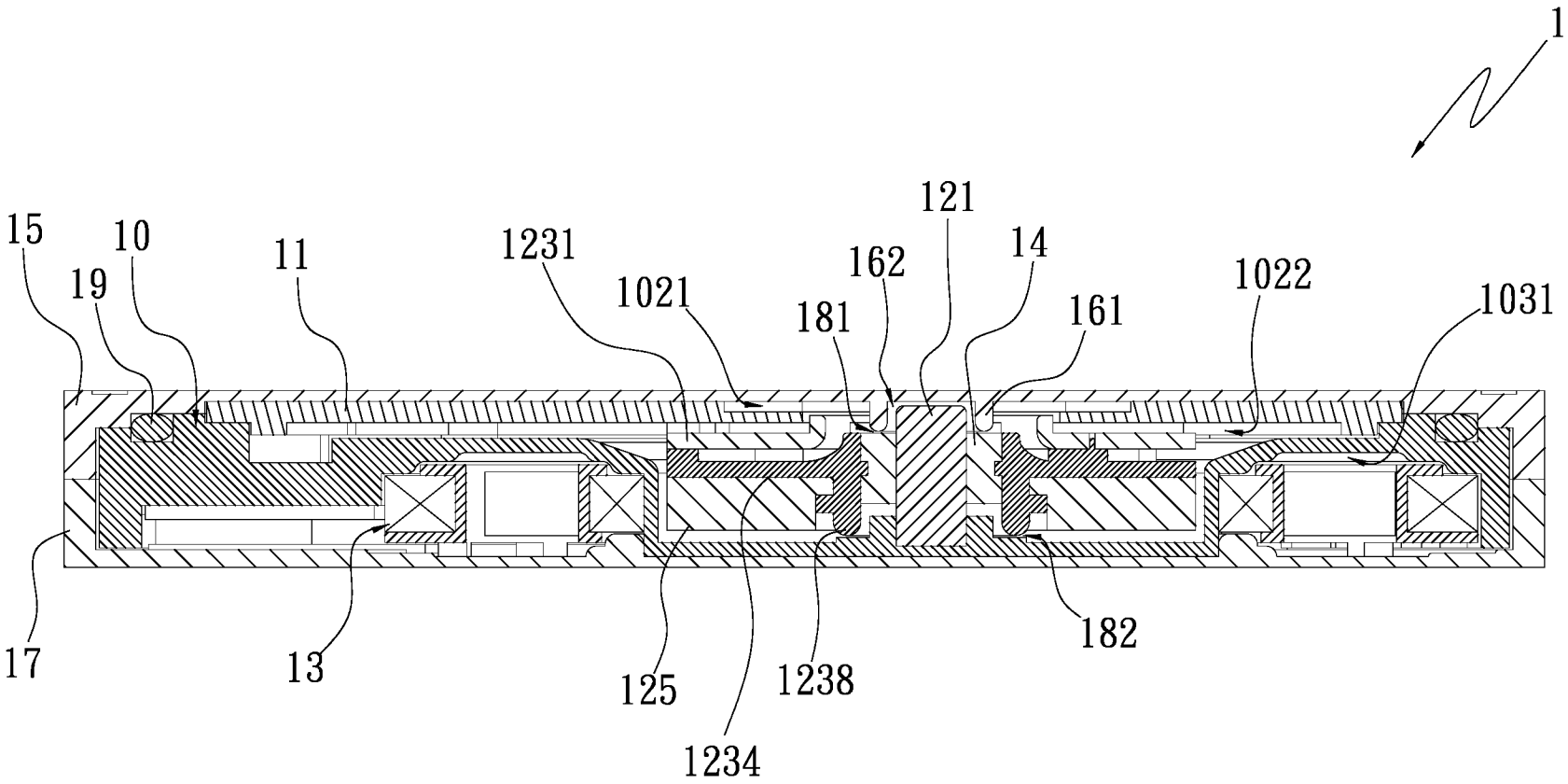
FIG. 2B is a schematic cross-sectional view of an embodiment of the present invention.
Figure 3:
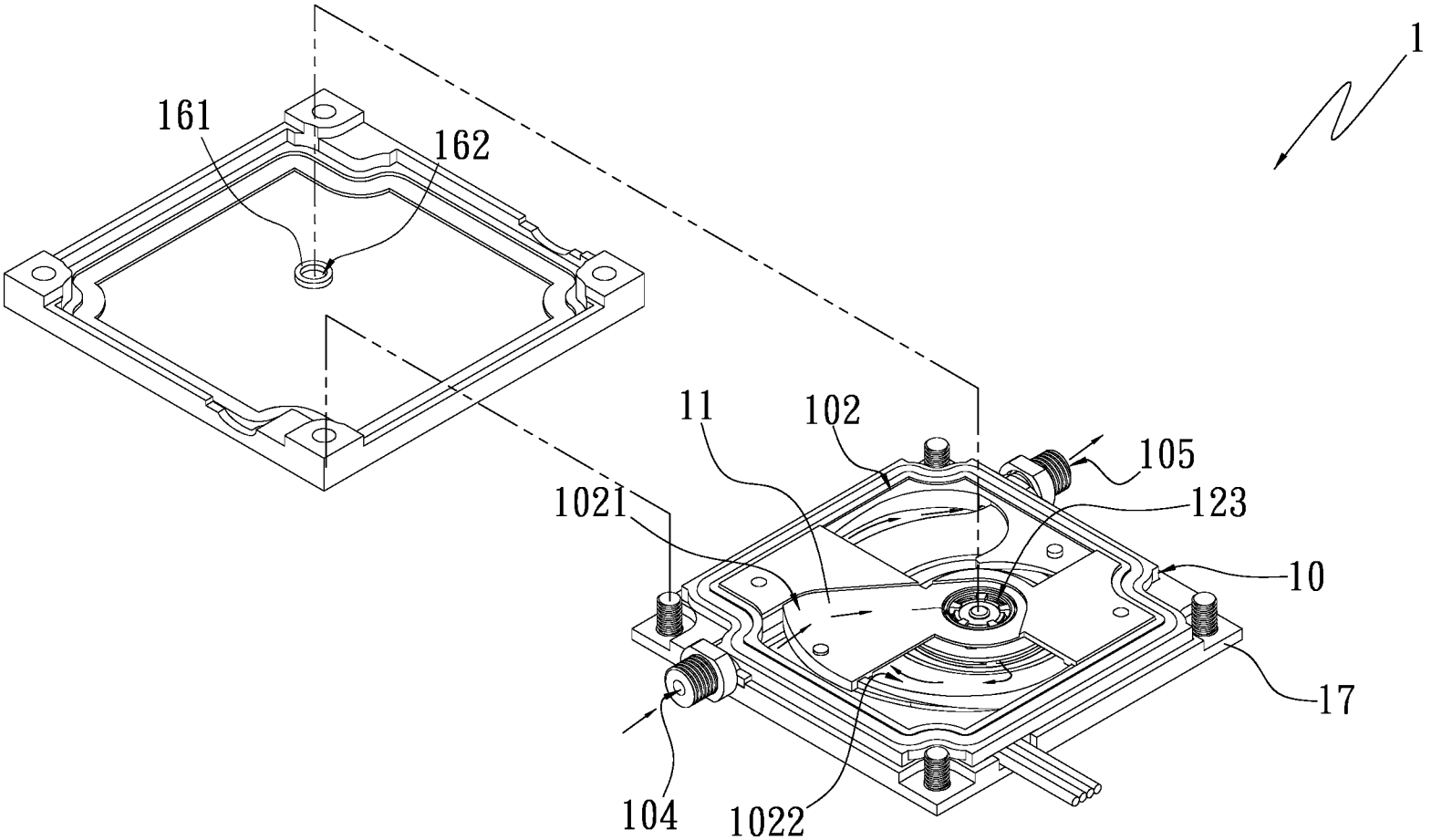
FIG. 3 is a schematic diagram of implementation of a miniature pump according to an embodiment of the present invention.
Figure 4:
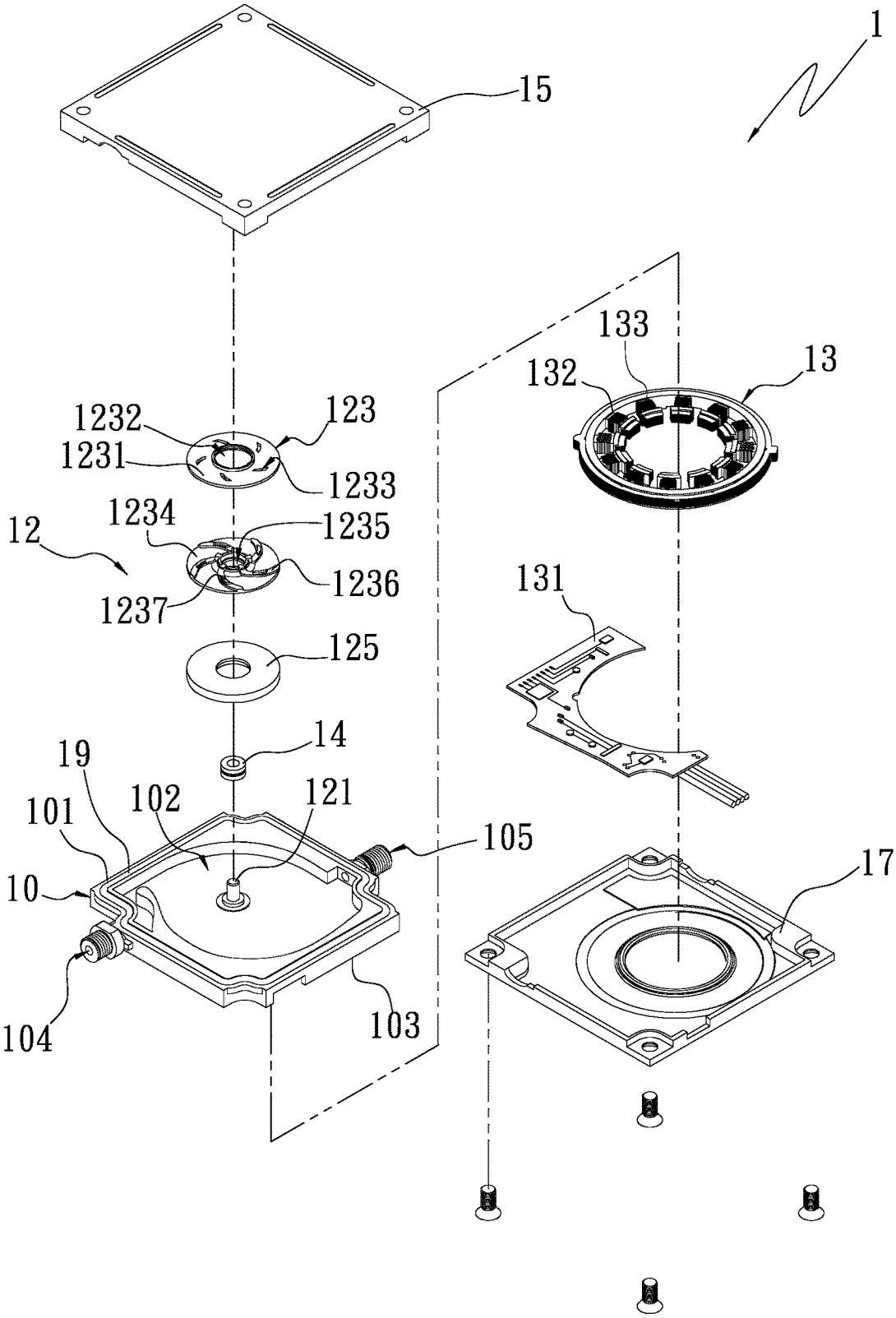
FIG. 4 is an exploded perspective view of an alternative embodiment of the present invention.
Figure 5:
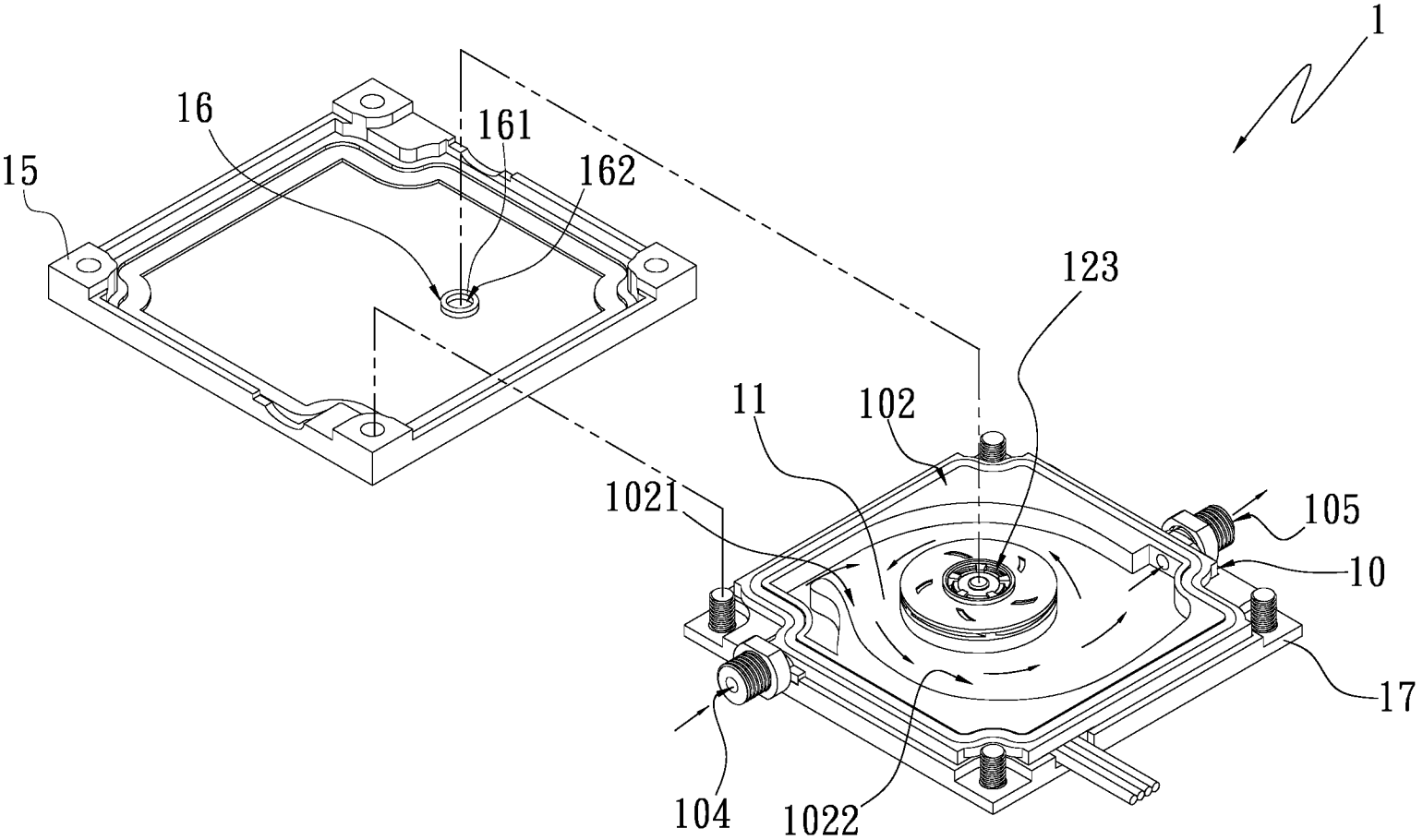
FIG. 5 is a schematic diagram of an implementation of a miniature pump according to an alternative embodiment of the present invention.

The invention provides a miniature pump. FIG. 1A is a three-dimensional exploded view of an embodiment of the present invention. FIG. 1B is a three-dimensional exploded schematic diagram from another perspective of an embodiment of the present invention. FIG. 2A is a schematic three-dimensional assembly diagram of an embodiment of the present invention. FIG. 2B is a schematic cross-sectional view of an embodiment of the present invention. FIG. 3 is a schematic diagram of implementation of a miniature pump according to an embodiment of the present invention. FIG. 4 is an exploded perspective view of an alternative embodiment of the present invention. FIG. 5 is a schematic diagram of an implementation of a miniature pump according to an alternative embodiment of the present invention. As shown in the figure, the miniature pump 1 includes a pump housing 10, a rotor 12, a stator 13, a closing member 15 and a holding member 16. The pump housing 10 is provided with a top side 101, a bottom side 103, an inlet 104 and an outlet 105. The inlet 104 and the outlet 105 are respectively located on both sides of the pump housing 10. The top side 101 is defined with a pumping chamber 102. The pump chamber 102 communicates with the inlet 104 and the outlet 105, and the top side 101 of the pump housing 10 is provided with a partition plate 11 that has the function of guiding water. The partition plate 11 is located in the pump chamber 102 to define a first chamber 1021 and a second chamber 1022 communicated with the outlet 105. The partition plate 11 is defined with a drainage hole 111 communicating the second chamber 1022 with the first chamber 1021. The inlet 104 communicates with the second chamber 1022 through the first chamber 1021 and the drainage hole 111. Consequently, following the introduction of a working fluid (such as pure water) into the first chamber 1021 from the inlet 104, the working fluid is directed by the drainage hole 111 and subsequently flows into the second chamber 1022. In addition, one side of the closing member 15 is connected to the top side 101 of the pump housing 10 to close the pump chamber 102, the first chamber 1021 is located between the closing member 15 and the partition plate 11, and the second chamber 1022 is located between the partition plate 11 and the bottom of the pump chamber 102. In the implementation of the present invention, a gasket 19 is provided between the closing member 15 and the pump housing 10. The gasket 19 serves to enhance the sealing effect between the closing member 15 and the pump housing 10, thereby preventing the leakage of the working fluid within the pump chamber 102.

In an alternative embodiment, referring to FIG. 4 and FIG. 5, the partition plate 11 is omitted so that the closing member 15 is directly covered on the top side 101 of the pump housing 10 to close the pump chamber 102. After the working fluid flows into the pump chamber 102 from the inlet 104, the rotor 12 disturbs the working fluid in the pump chamber 102 and drives the working fluid to be discharged toward the outlet 105, thereby continuously dissipating heat through water circulation.

The bottom side 103 of the pump housing 10 is defined with a recessed space 1031, which is formed by the housing 10 being recessed from the bottom side 103. The recessed space 1031 is separated from the pump housing 10 by the bottom side 103 so that it is not in communication with the pump chamber 102, the inlet 104, and the outlet 105. The recessed space 1031 is utilized for the accommodation of the stator 13, and a cover plate 17 is attached to the bottom side 103 of the pump housing 10. This serves to close the recessed space 1031, thereby protecting the stator 13 from the intrusion of foreign objects or damage caused by impact. One end of the cover plate 17 is affixed to an end corresponding to the closing member 15, thereby enclosing the pump housing 10 between the closing member 15 and the cover plate 17, thus providing effective protection for the pump housing 10.

The rotor 12 is provided at the bottom of the pump chamber 102 (i.e. at the bottom of the second chamber 1022) and exposed to the working fluid. The rotor 12 located in the pump chamber 102 is inductively magnetized across the pump housing 10 with the stator 13 positioned within the corresponding recessed space 1031. Consequently, when the impeller 123 is driven to rotate by the mutual induction magnetization between the rotor 12 and the stator 13, the working fluid in the inlet 104 will flow into the second chamber 1022 through the first chamber 1021 and the drainage hole 111 on the partition plate 11, at which time the impeller 123 will disturb the working fluid in the second chamber 1022 and cause it to flow outwards from the outlet 105 (as shown in FIG. 3).

The rotor 12 is provided with an impeller 123, a magnetic member 125 corresponding to the impeller 123 and a shaft 121. One end of the shaft 121 is fixed to the bottom of the pump chamber 102 and does not rotate, and the other end of the shaft 121 is accommodated in the holding member 16. A bearing 14 is pivoted on the shaft 121, and the bearing 14 rotates on the shaft 121 together with the impeller 123 as the impeller 123 is driven to rotate. The impeller 123 is disposed outside the bearing 14 for circulating the working fluid within the pump chamber 102. The impeller 123 is provided with an impeller cover 1231, a plurality of blades 1236, and an impeller base 1234 connected to the impeller cover 1231. The impeller cover 1231 is provided with a first sleeve hole 1232 and docking holes 1233. The first sleeve hole 1232 penetrates through the center of the impeller cover 1231, and the docking holes 1233 are arranged in a radial configuration on the impeller cover 1231 corresponding to the periphery of the first sleeve hole 1232. The impeller base 1234 is provided with a second sleeve hole 1235 opposite to the first sleeve hole 1232. The first sleeve hole 1232 and second sleeve hole 1235 are sleeved on the exterior of bearing 14. The blades 1236 are arranged in a radial configuration on an upper side of the impeller base 1234, and each blade 1236 has a bump 1237 that can be connected to a corresponding docking hole 1233. This allows the impeller cover 1231 and the impeller base 1234 to be integrated into one body, forming the impeller 123. The lower side of the impeller base 1234 is attached to a corresponding side of the magnetic member 125 (such as the upper surface of the magnetic member 125).

Furthermore, the stator 13 is isolated from the working fluid within the pump chamber 102, thus preventing exposure to the working fluid. The stator 13 is provided with a circuit board 131, a silicon steel sheet group 132 and a coil group 133 wound on the silicon steel sheet group 132. The circuit board 131 (e.g., a printed circuit board 131) is electrically connected to the coil group 133. The circuit board 131 is provided with a plurality of electronic components (e.g., a processor and other electronic components). The holding member 16 may be composed of a metal material (e.g. aluminum, titanium, iron, copper or alloy material), a plastic material (e.g. soft plastic or hard plastic) or a rubber material (e.g. soft rubber, hard rubber, thermoplastic polyurethane elastomer rubber). The holding member 16 is provided on the inner side of the closing member 15 corresponding to the bearing 14. In this embodiment, the holding member 16 is produced as an integral component on the inner side of the closing member 15 through the process of injection molding. The holding member 16 has a flange portion 161 which projects in an axial direction from the inner side of the closing member 15. The free end of the flange portion 161 is rounded and chamfered. The flange portion 161 is defined with an accommodation space 162 to accommodate the other end of the shaft 121. The width of the accommodation space 162 is greater than the diameter of the shaft 121, and the width of the outer diameter of the flange portion 161 is less than the width of the outer diameter of the bearing 14.

In one embodiment, the holding member 16 and the closing member 15 are two separate elements. These two elements may be of the same material (e.g., the holding member 16 and the closing member 15 are made of plastic or metal). Alternatively, they may be of different materials (e.g., the holding member 16 is made of rubber and the closing member 15 is made of plastic). The flange portion 161 of the holding member 16 is formed on the inner side of the closing member 15 by a process of adhesion, embedding, welding or injection molding.

In addition, a first axial gap 181 is formed between the flange portion 161 and a corresponding end of the bearing 14. The first axial gap 181 provides an axial space in which the rotor 12 and the bearing 14 can move upwardly and downwardly (or axially) together during rotation. Accordingly, the free end of the flange portion 161 of the holding member 16 is brought into direct contact with the surface of one end of the bearing 14, which is moving axially within the first axial gap 181. This configuration ensures that the impeller cover 1231 of the impeller 123 does not contact with the partition plate 11 and the inner side of the closing member 15. Consequently, there is no friction in the axial direction of the impeller 123, which effectively avoids friction and also effectively reduces the noise of the miniature pump 1 in operation.

The impeller base 1234 is further provided with an annular flange 1238. The annular flange 1238 extends in an outward direction from the lower side of the impeller base 1234 adjacent to the second sleeve hole 1235. A second axial gap 182 is formed between the annular flange 1238 and the bottom of the chamber 102 corresponding to the annular flange 1238. The second axial gap 182 provides an axial space for the rotor 12 to move in an upward and downward direction (axial movement) during rotation. Consequently, the annular flange 1238 of the impeller 123 makes direct contact with the bottom surface of the pumping chamber 102 when it moves axially within the second axial gap 182. This prevents the impeller base 1234 of the impeller 123 and the magnetic member 125 from making contact with the bottom surface of the pumping chamber 102. This configuration permits the impeller 123 to move without friction in the axial direction, thereby effectively avoiding friction and reducing noise.

Accordingly, the configuration of the miniature pump 1 enables the effective avoidance of friction and the extension of the service life of the miniature pump 1, while simultaneously reducing noise. Furthermore, the miniature pump 1 can be utilized in conjunction with a water-cooling apparatus (not shown). By means of the miniature pump 1, the working fluid can be circulated to dissipate heat through a process of heat exchange between a water-cooling apparatus head and a water-cooling radiator, thereby achieving the effect of water-cooling heat dissipation.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A miniature pump comprising:

a pump housing having a top side, a bottom side, an inlet, and an outlet, wherein a pump chamber is defined on the top side, the pump chamber communicates with the inlet and the outlet, an end of a shaft is fixed in the pump chamber, and a bearing is pivoted on the shaft;

a rotor disposed on the pump chamber and exposed to a working fluid, wherein the rotor is provided with an impeller having an impeller cover and with a magnetic member corresponding to the impeller, wherein the impeller is disposed outside the bearing to circulate the working fluid passing through the pump chamber;

a stator disposed on the bottom side of the pump housing and corresponding to the magnetic member, wherein the stator is isolated from the working fluid;

a closing member, wherein a side of the closing member is connected to the top side of the pump housing to close the pump chamber; and a holding member disposed on a side of the closing member corresponding to the bearing, wherein another end of the shaft is accommodated in the holding member and wherein the holding member inhibits the impeller cover from contacting the closing member.

2. The miniature pump of claim 1, wherein a partition plate is provided on the top side of the pump housing, the partition plate is located in the pump chamber to define a first chamber and a second chamber, the partition plate is defined with a drainage hole, and the inlet communicates with the second chamber through the first chamber and the drainage hole.

3. The miniature pump of claim 1, wherein the holding member comprises a flange portion projecting from an inner side of the closing member in an axial direction, a first axial gap is formed between the flange portion and a corresponding end of the bearing, and the flange portion is defined with an accommodation space to accommodate another end of the shaft.

4. The miniature pump of claim 3, wherein a free end of the flange portion is rounded and chamfered, and a width of the accommodation space is greater than a diameter of the shaft.

5. The miniature pump of claim 3, wherein a width of an outer diameter of the flange portion is less than an outer diameter of the bearing.

6. The miniature pump of claim 3, wherein the impeller is provided with a plurality of blades and an impeller base connected to the impeller cover, wherein the impeller cover is defined with a first sleeve hole and a plurality of docking holes, the first sleeve hole penetrates a center of the impeller cover, the plurality of docking holes are arranged in a radial configuration on the impeller cover corresponding to a periphery of the first sleeve hole, the impeller base is defined with a second sleeve hole opposite to the first sleeve hole, the first sleeve hole and the second sleeve hole are sleeved on an outside of the bearing, the plurality of blades are arranged in a radial configuration on an upper side of the impeller base, and the plurality of blades each has a bump connected to a corresponding docking hole, and a lower side of the impeller base is attached to a side of the magnetic member facing the impeller base.

7. The miniature pump of claim 6, wherein the impeller base is further provided with an annular flange extending outward from the lower side of the impeller base adjacent to the second sleeve hole, and a second axial gap is formed between the annular flange and a bottom of the pump chamber corresponding to the annular flange.

8. The miniature pump of claim 1, wherein the bottom side is defined with a recessed space, the recessed space is not communicated with the pump chamber, the inlet and the outlet, the stator is accommodated in the recessed space and is not exposed to the working fluid, the stator is provided with a circuit board, a silicon steel sheet group and a coil group wound around the silicon steel sheet group, the circuit board is electrically connected to the coil group, a plurality of electronic components are provided on the circuit board, the bottom side of the pump housing is connected to a side of a cover plate, the cover plate is configured to close the recessed space, and an end of the cover plate is connected to an end of the closing member corresponding to the cover plate.

9. The miniature pump of claim 1, wherein the holding member is integrally formed on an inner side of the closing member by a process of injection molding.

10. The miniature pump of claim 1, wherein the holding member consists of metal, plastic or rubber.

* * * * *